362-111
11/18/80 OR 4,234,911

United States Patent [19]
Faith

[11] 4,234,911
[45] Nov. 18, 1980

[54] OPTICAL FIRING ADAPTOR

[76] Inventor: Donald L. Faith, 1503 Park Rd., S.E., Atlanta, Ga. 30315

[21] Appl. No.: 20,958

[22] Filed: Mar. 13, 1979

[51] Int. Cl.[3] ..... F41G 1/34
[52] U.S. Cl. ..... 362/111; 273/318
[58] Field of Search ..... 362/110, 111, 112, 113, 362/114; 273/101.1

[56] References Cited

U.S. PATENT DOCUMENTS

| | | | |
|---|---|---|---|
| 3,240,924 | 3/1966 | Darby | 362/111 |
| 3,510,965 | 5/1970 | Rhea | 362/111 |
| 3,526,972 | 9/1970 | Sumpf | 362/111 |
| 4,048,489 | 9/1977 | Giannetti | 362/110 |

*Primary Examiner*—Monroe H. Hayes
*Attorney, Agent, or Firm*—Cushman, Darby & Cushman

[57] ABSTRACT

An optical apparatus adapted for insertion into the open end of a hand-gun barrel. A piezoelectric crystal produces an output signal in response to the hammer impact to cause an LED to be intermittently operated by an oscillator powered by batteries and produce pulses of light which are directed by a lens onto a target. The oscillator is also coupled to a counter which is reset by the crystal output and which disables a gate between oscillator and LED upon a first count and enables a gate connecting the counter reset to the crystal upon a second count.

12 Claims, 3 Drawing Figures

OPTICAL FIRING ADAPTOR

BACKGROUND AND SUMMARY OF THE INVENTION

The invention relates to an optical apparatus for insertion into the open end of a gun barrel to produce short pulses of infrared light realistically simulating the firing of the gun.

Dry firing of long and hand-guns, that is, operation of the gun without ammunition has long been an accepted technique for improving skills. The technique is advantageous in that no firing range is required, and no ammunition is expended. The difficulty is that the marksman has no way of judging the results of his practice and little interest is provided during practice.

In order to provide a more realistic and interesting practice session, various systems have been proposed to produce an optical or other signal when a weapon is operated. One device currently available uses a source of light which is inserted into a hand-gun in place of the cylinder. When the trigger is pulled, a beam of light is produced which can be seen on a target some distance away to produce an indication of whether the firearm was properly aimed.

The difficulty with this system is that the gun is operated under practice conditions which are quite different from the actual firing conditions. The feel and weight of the gun will be different when the real cylinder is replaced. Since the device replaces the cylinder, a separate model is required for each different size and model of gun. In addition, it is difficult for such devices to be fired quickly enough in succession to be suitable for training. Parital disassembly of the hand-gun is required in order for the device to be used.

Other devices for simulating fire of a hand-gun have been developed which are inserted into the gun barrel. Such devices produce an optical or other signal in response to closing of a switch. Positioning and accurate operation of the switch is, however, difficult. The patent to Sump, U.S. Pat. No. 3,526,672, shows one device of this type. The patent to Giannetti, U.S. Pat. No. 4,048,489, describes a similar system in which a light pulse generator is contained in a gun sight holder.

The present invention relates to a unique apparatus for insertion into a gun barrel to produce pulses of light. The device is completely self-contained, and no external trigger is required. Rather, the vibrations produced by the hammer impact upon pulling of the trigger are detected to produce an electrical pulse which operates a light source to produce a short burst of pulses of light. The light can be detected by any suitable photo-sensitive device at the target to indicate if the hand or other gun was properly sighted so that if live ammunition had been used a hit would have resulted.

Since the device is inserted into the weapon without any modification or change in the weapon, the simulated fire is exactly identical to firing with live ammunition. No disassembly of the hand-gun is required; the present invention is simply slipped into the barrel. Since the bore diameters for all guns of similar calibre are roughly the same, one model can serve for weapons of all calibres which are roughly the same. It is particularly contemplated that one size would be appropriate for 44 and 45 calibre hand-guns and another size for 38 special, 9 mm, 357 magnum, and similar calibre hand-guns.

Another advantage of the present invention is its simplicity and reliability. Only a few components are required, and they can be made and assembled inexpensively and without difficulty.

In the specific embodiment of the invention described below, a piezoelectric sensor is used to detect the vibrations and produce an output signal which triggers an oscillator to apply a sequence of electrical pulses to a photo-diode, for example, an infrared emitting diode. The output of the photo-diode is gathered by a lens at the end of the barrel and directed to the target. A lens at the target preferably gathers the incident light onto a photodetector to produce a signal which can be used to provide any suitable indication of a hit. For example, a light could be illuminated, a sound could be given, etc. The unit is preferably powered by a plurality of batteries mounted in the unit and suitably connected to the circuit.

The output signal from the crystal is applied to the reset input of a counter via a logic gate which then prevents further resetting. The counter is connected to the oscillator and disables a gate between the oscillator and light source upon a first count. Upon a second count, the logic gate is again enabled to permit the counter to be again reset.

Any suitable case for the device can be utilized, for example, the case can be formed in a shell casing which can be separated to readily replace the batteries. By using short pulses of light, rather than a continuous beam of visible light, the most realistic simulation of actual fire is provided since any movement of the hand-gun after the burst has ceased will not produce an indication of a hit. Further, by producing only a short pulse of light, the lifetime of the batteries is maximized. A range of thirty to fifty feet is possible with hearing aid cells lasting for over one thousand shots.

DETAILED DESCRIPTION OF THE DRAWINGS

Figure 1:
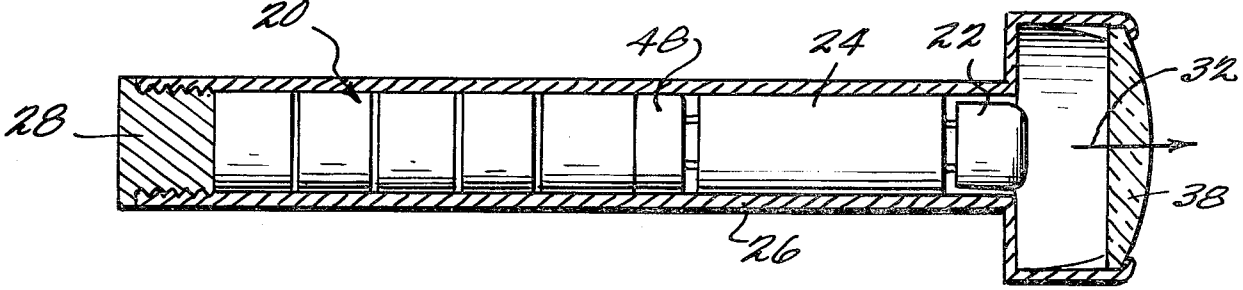
FIG. 1 shows a sectional view of one embodiment of the present invention.

Reference is now made to FIG. 1 which illustrates one embodiment of the present invention. A plurality of batteries 20, a source of light 22, preferably an LED producing infrared light, and an electronic circuit 24 are contained within a housing 26 which is adapted to be received within the open end of a hand-gun barrel. Housing 26 is sealed at one end by a threaded end cap 28 and provided at the other end with a lens 30 which directs the pulses of light produced by source 22 to a target along the direction of arrow 32.

Any suitable batteries can be utilized and four silver oxide cells of the type commonly used in hearing aids have been found to be satisfactory. It is contemplated that for most hand-guns the housing will be about three inches in length and will be easy to insert and remove from the end of the barrel. The housing may be made of any suitable material, except metal, and the LED 22 and lens 32 are preferably conventional types of devices.

Figure 2:
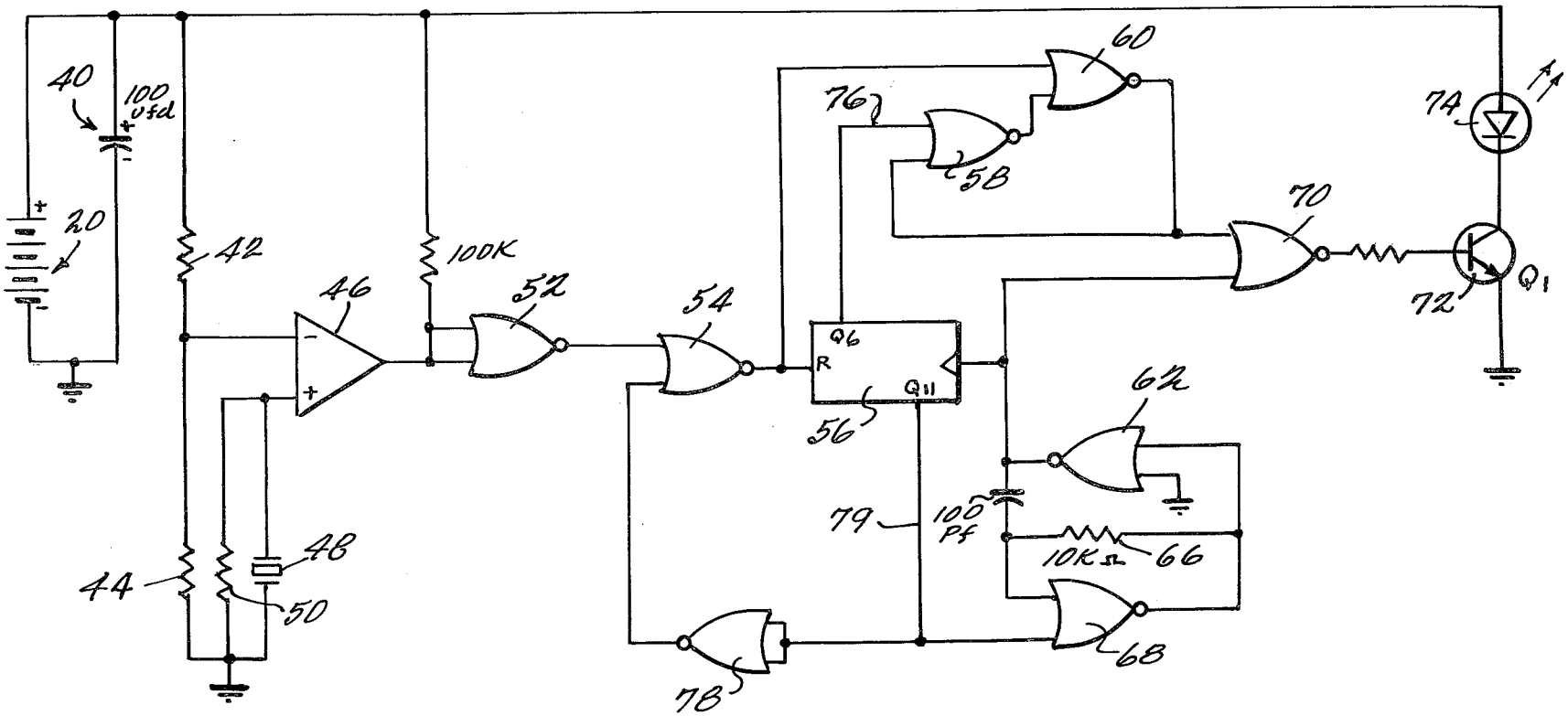
FIG. 2 shows a schematic of the circuitry of FIG. 1.

FIG. 2 shows a schematic of the circuitry 24. A capacitor 40 is connected in parallel with the batteries 20 which are in turn connected via voltage dividing resistors 42 and 44 to the negative input of voltage comparator 46. A conventional piezo-electric sensor 48 with a resistor 50 connected in parallel with it are connected to the positive input of voltage comparator 46. Piezoelectric sensor 48 responds to the impact of the hammer when the gun is fired without ammunition by producing a positive voltage which causes the output of voltage comparator 46 to shift from a low to a high output condition. The shift of the output of the voltage comparator 46 is inverted by gate 52 so that both inputs to gate 54 are now low, resetting counter 56 and setting gates 58 and 60 which comprises a latch as described further below. An oscillator comprising gate 62, capacitor 64, resistor 66 and gate 68 is now enabled and produces pulses which are now counted by counter 56 to a predetermined count, for example, 1024. At the same time, the output of the oscillator is applied via gate 70 to transistor 72, which is thus intermittently rendered conductive to permit current to flow through LED 74 and produce pulses of infrared light which are directed to the target.

Figure 3:
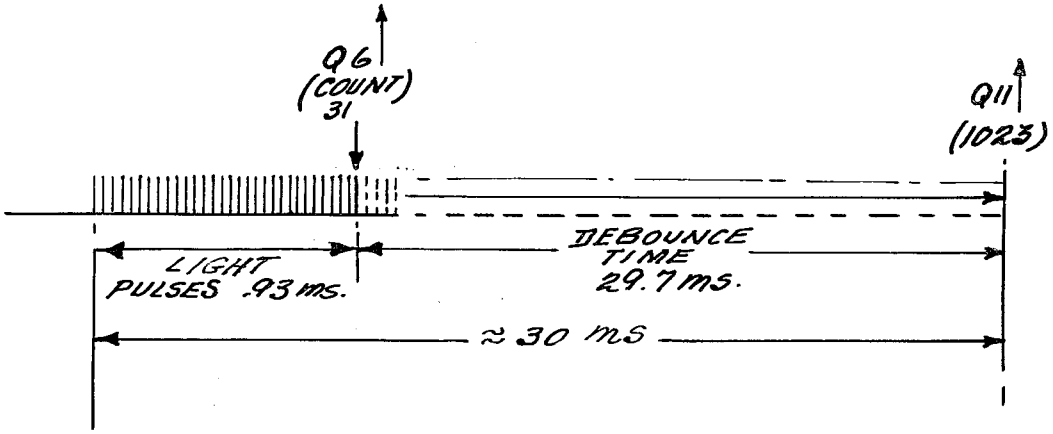
FIG. 3 shows the signals produced by the circuitry of FIG. 2.

When counter 56 reaches a first count, e.g., 32, as shown in FIG. 3, output lines 76 goes high which resets the latch comprising gates 58 and 60 and disables gate 70 so that no further pulses are applied to transistor 72. Upon a subsequent count, for example, 1024, output line 78 goes high so that a low input is applied to gate 54 via gate 78. This also holds the output of gate 68 low disabling the oscillator. Counter 56 can now be reset by a subsequent signal from piezo-electric crystal 48. The interval between the time when line 76 goes high and the time when line 78 goes high insures that the piezoelectric crystal output from the first hammer impact will have returned to its low value and another series of pulses will not be produced.

Many changes and modifications in the above described embodiment of the invention can, of course, be carried out without departing from the scope thereof. Accordingly, that scope is intended to be limited only by the scope of the appended claims.

What is claimed is:

1. An apparatus for insertion in a gun barrel to produce pulses of light simultaing firing of the gun comprising:

means for detecting vibrations produced by the hammer impact resulting from pulling the trigger and producing at least one electrical pulse in response thereto;

a source of electrical energy connected to said detecting and producing means; and a light source connected to said detecting and producing means for producing said pulses in response to said electrical pulse.

2. An apparatus as in claim 1, further including a housing adapted for fitting into the open end of a handgun barrel and containing said detecting means, electrical energy source, and light source.

3. An apparatus as in claim 1, wherein said electrical energy source includes at least one battery.

4. An apparatus as in claim 3, including a plurality of said batteries connected in series.

5. An apparatus as in claim 1, or 2, wherein said detecting means includes a piezoelectric crystal for producing an output signal in response to hammer impact and oscillator means for producing a plurality of said electrical pulses in response to said output signal.

6. An apparatus as in claim 5, wherein said oscillator means includes an oscillator circuit, a counter for counting said electrical pulses and logic means connected to said counter and connecting said oscillator circuit to said light source for applying said electrical pulses to said crystal until the count in said counter reaches a predetermined count.

7. An apparatus as in claim 6, wherein said logic means connected between said oscillator and said crystal for resetting said counter in response to said output signal and for preventing resetting thereafter until said counter reaches a second count greater than said predetermined count.

8. An apparatus as in claim 1, 2, 3, or 4, wherein said light source is an LED.

9. An apparatus as in claim 8, including a lens in said housing for directing said pulses of light onto a target.

10. A circuit for producing a burst of optical pulses, said circuit being adapted for fitting within the barrel of a gun, comprising:

a piezo-electric crystal for producing an output signal in response to hammer impact of the gun;

an oscillator for producing electrical pulses;

an LED;

means for applying said electrical pulses to said LED in response to said output signal so that said LED produces said optical pulses.

11. A circuit as in claim 10, wherein said means includes means for preventing said electrical pulses from being applied to said LED for a given time after said optical pulses are produced.

12. A circuit as in claim 10, wherein said means includes a counter for counting the electrical pulses produced by said oscillator and gate means connecting said oscillator to said LED for preventing application of further electrical pulses after said counter reaches a predetermined count.

* * * * *